US005118569A

United States Patent [19]

Kuroda et al.

[11] Patent Number: 5,118,569

[45] Date of Patent: Jun. 2, 1992

[54] REINFORCEMENT SHEET

[75] Inventors: Toshimasa Kuroda, Takatsuki; Yoshimi Tanaka, Ayabe; Takashige Oka, Funai; Kouichi Yamada, Ibaraki; Nobutaka Kiyohara, Narashino; Akihiro Sato, Ayabe; Mitsuo Hosoi, Konan, all of Japan

[73] Assignees: Teijin Limited, Osaka; Gunze Limited, Kyoto, both of Japan

[21] Appl. No.: 474,028

[22] PCT Filed: Sep. 1, 1989

[86] PCT No.: PCT/JP89/00900

§ 371 Date: Apr. 25, 1990

§ 102(e) Date: Apr. 25, 1990

[87] PCT Pub. No.: WO90/02831

PCT Pub. Date: Mar. 22, 1990

[30] Foreign Application Priority Data

| | | | |
|---|---|---|---|
| Sep. 2, 1988 | [JP] | Japan | 63-220990 |
| Mar. 1, 1989 | [JP] | Japan | 1-46570 |
| Apr. 6, 1989 | [JP] | Japan | 1-85714 |
| May 25, 1989 | [JP] | Japan | 1-130055 |
| May 25, 1989 | [JP] | Japan | 1-130056 |

[51] Int. Cl.[5] ..... B32B 7/00

[52] U.S. Cl. ..... 428/367; 428/373; 428/253; 428/902; 66/190; 66/202

[58] Field of Search ..... 428/253, 373, 367, 902; 66/190, 202

[56] References Cited

U.S. PATENT DOCUMENTS 4,183,993 1/1980 Benstead et al. ..... 66/190

FOREIGN PATENT DOCUMENTS

| | | | |
|---|---|---|---|
| 1585079 | 2/1962 | Fed. Rep. of Germany . | |
| 48-50055 | 7/1973 | Japan . | |
| 588161 | 7/1981 | Japan . | |
| 58-8162 | 1/1983 | Japan . | |
| 1275705 | 5/1972 | United Kingdom | 428/367 |

OTHER PUBLICATIONS

English translation of JP 48-50055, pp. 1-8.
English translation of JP 58-8162, pp. 1-9.
English translation of JP 58-8161, pp. 1-8.

*Primary Examiner*—George F. Lesmes
*Assistant Examiner*—Beverly A. Pawlikowski
*Attorney, Agent, or Firm*—Burgess, Ryan & Wayne

[57] ABSTRACT

The disclosed reinforcement sheet is a knitted fabric formed from a plurality of reinforcing yarns 5 and a plurality of matrix yarns 9, wherein the reinforcing yarns are held in the linear state without being bent, arranged in parallel to and spaced from one another in a matrix knitting structure, and the matrix yarns cover the linear reinforcing yarns, without bending the linear reinforcing yarns, to form the matrix knitting structure.

9 Claims, 17 Drawing Sheets

REINFORCEMENT SHEET

TECHNICAL FIELD

The present invention relates to a reinforcement sheet having a novel structure. More particularly, the present invention relates to a reinforcement sheet having a novel structure, and useful for preparing, by a thermal shaping (forming) method, a composite material comprising a thermoplastic polymer as a matrix and high-strength high-modulus filament yarns as a reinforcing material.

BACKGROUND ART

For example, a unidirectional cord fabric (see U.S. Pat. No. 3,859,158) is known as the conventional reinforcement sheet, but this fabric is defective in that, since reinforcing yarns arranged in the warp direction are bent by the pressure thereon of wefts, the capacity of the reinforcing yarns is weakened. Moreover, the fabric is defective in that the reinforcing yarns are not tightly bonded to wefts, crossing points between the reinforcing yarns and wefts are liable to shift, and the handling and processability thereof are poor. Moreover, this fabric has a serious defect in that, since the reinforcing yarns are first bonded to one another by a resin, the fabric has no pliability and the fitting of the fabric in a mold at the molding step is difficult.

As the means for overcoming these defects, there has been proposed a soft reinforcement sheet (fabric) comprising a reinforcing thermoplastic yarn (constituting a matrix after thermal shaping) and a reinforcing yarn (see U.S. Pat. No. 3,620,892, British Patent No. 1,228,573 and British Patent No. 1,226,409). Nevertheless, even according to this proposal, since the matrix yarns and reinforcing yarns are woven into a fabric, the reinforcing yarns in the fabric structure are still bent, and the defect that the capacity of the reinforcing yarns is weakened is not overcome.

Japanese Unexamined Patent Publication No. 60-28543 discloses a method in which polyether ether ketone fiber (matrix fiber) yarns and reinforcing fiber yarns are woven or knitted into a woven fabric, knitted fabric or mat. This prior art technique, for example, in connection with a knitted fabric, teaches only a warp-knitted fabric obtained by arranging matrix fiber yarns and reinforcing fiber yarns, alternately one by one, and knitting them with auxiliary yarns such as polyether ether ketone fiber yarns or glass fiber yarns.

Also, in this case, the reinforcing yarns in the structure of the warp-knitted fabric are bent, and therefore, the above problem is not solved.

DISCLOSURE OF THE INVENTION

An object of the present invention is to provide a reinforcement sheet having a good pliability and an improved handling and formability, and useful for producing a shaped article therefrom in which the maximum capacity of reinforcing yarns is obtained.

Another object of the present invention is to provide a reinforcement sheet comprising reinforcing yarns kept in the linear state without being bent, in which the reinforcing yarns are not exposed to the outer side of the obtained shaped article.

The reinforcement sheet of the present invention has a knitting structure and is characterized in that reinforcing yarns are held in the linear state without being bent in a matrix knitting structure composed of matrix yarns.

More specifically, the reinforcement sheet of the present invention has a knitting structure comprising a plurality of reinforcing yarns 5, a plurality of matrix yarns 9 and a plurality of heat-fusion-bondable yarns 6*a*–6*c*, wherein the reinforcing yarns are held in the linear state without being bent, at least one reinforcing yarn is doubled, mixed, entangled or double-twisted with at least one heat-fusion-bondable yarn or arranged between two heat-fusion-bondable yarns 6 to form a composite yarn, the composite yarns are arranged in parallel to and spaced from one another, and the matrix yarns are knitted around the composite yarns to cover the reinforcing yarns, whereby a plurality of repeating knitting units P, which are parallel to one another, are formed and the knitting units are connected to one another to form a continuous matrix knitting structure, wherein the total volume fraction of the composite yarns is 30 to 60% and the volume ratio of the reinforcing yarns to the entire sheet is 40 to 70%.

In the repeating knitting units P, the linear reinforcing yarns can be covered with the matrix yarns, or can be covered with racking yarns composed of the matrix yarns. Furthermore, the repeating knitting units P can be connected to one another through course knitting structures of the matrix yarns to form a hosiery knitted fabric structure.

In the reinforcement sheet of the present invention, since reinforcing yarns are covered with matrix yarns, and the reinforcing yarns are held in the linear state, without being bent, in the knitting structure, the strength of the sheet per se is high, the sheet can be handled very easily and has an extremely reliable reinforcing effect.

BEST MODE OF CARRYING OUT THE INVENTION

The structure of the reinforcement sheet of the present invention will now be described with reference to the accompanying drawings.

Figure 1:
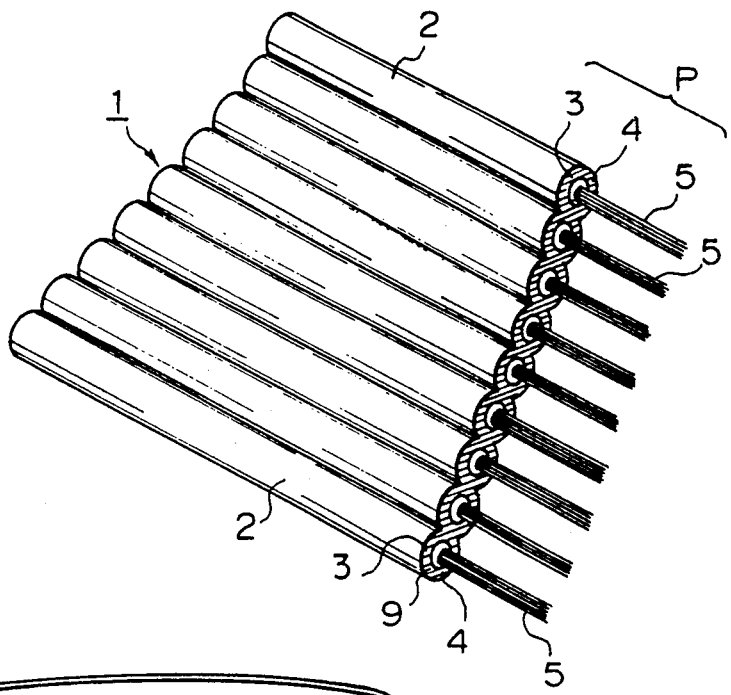
FIG. 1 is a partially cut-out perspective view illustrating an embodiment of the reinforcement sheet of the present invention.
Figure 2:
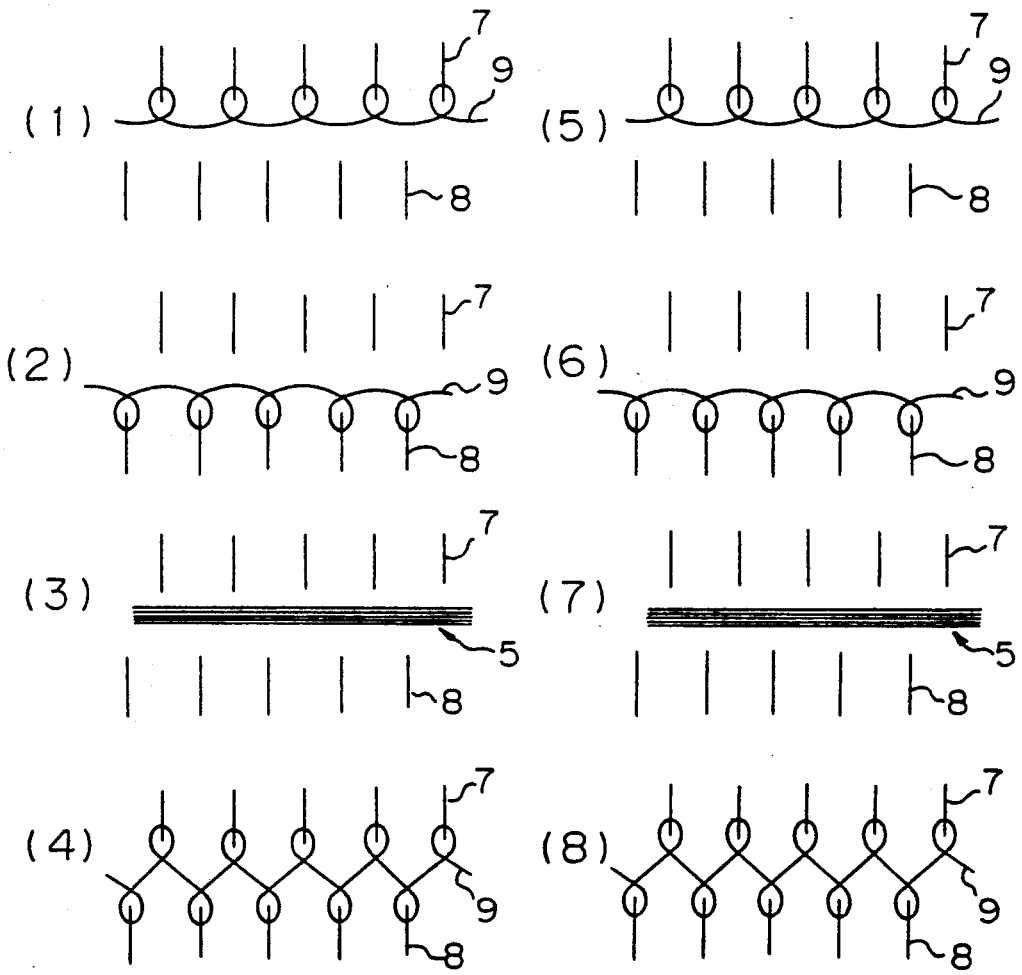
FIG. 2 is a knitting diagram (modified Milano rib stitch structure) for forming a cylindrical knitted fabric for the reinforcement sheet of the present invention by using a circular rib knitting machine.

In a reinforcement sheet 1 shown in FIGS. 1 and 2, matrix yarns 9 constitute a tubular plain stitch-like matrix hosiery knitting structure 2, and this hosiery knitting structure 2 has a front fabric 3 and a back fabric 4. Reinforcing yarns 5 are inserted between the front fabric 3 and back fabric 4 of the hosiery knitting structure 2 composed of the matrix yarns 9, while the reinforcing yarns 5 are held in the linear state without being bent.

In this knitting structure, the reinforcing yarns 5 are arranged in parallel to and spaced from one another, and therefore, repeating knitting units P formed by covering the reinforcing yarns 5 with the matrix yarns 9 in the form of a bag are arranged in parallel to and connected with one another through the matrix yarns 9 to form a continuous matrix knitting structure.

The process for preparing the knitted fabric sheet shown in FIG. 1 will now be described with reference to FIG. 2.

At first and second feeders shown in FIGS. 2-(1) and 2-(2), matrix yarns 9 are fed to an upper needle 7 and a lower needle 8 and are knitted into the front fabric 3 and back fabric 4 respectively in accordance with a predetermined structure. At a third feeder shown in FIG. 2-(3), reinforcing yarns 5 are inserted between the front fabric 3 and back fabric 4 and are knitted. Furthermore, at a fourth feeder shown in FIG. 2-(4), the matrix yarns 9 are fed to the upper needle 7 and lower needle 8 and are knitted to form a tubular plain stitch-like matrix hosiery knitted fabric 2.

The knitting operation is then carried out at fifth to eighth feeders shown in FIGS. 2-(5) through 2-(8) with the same knitting operations as at the first to fourth feeders, whereby a cylindrical knitted fabric is continuously formed. The fabric is cut in the vertical row direction to a predetermined length and the cut fabric is opened, whereby a flat reinforcement sheet 1 as shown in FIG. 1 is obtained.

Figure 3:
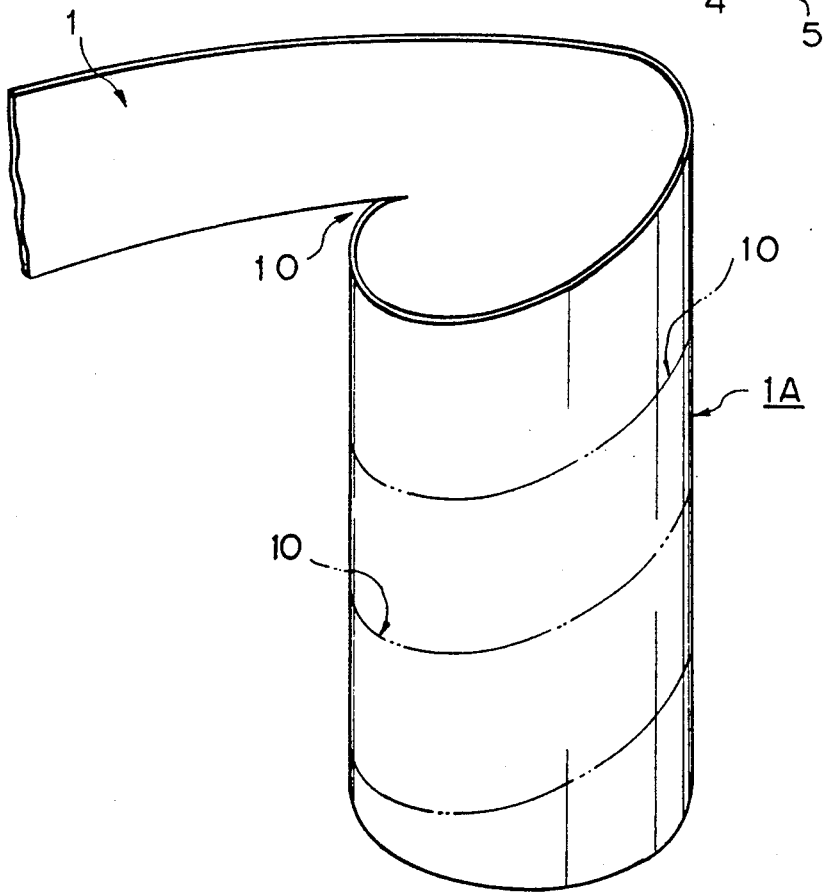
FIG. 3 is a perspective view showing the step of forming the reinforcement sheet of the present invention by opening the cylindrical fabric obtained according to the knitting method shown in FIG. 2.

FIG. 3 shows an example of the step of preparing the sheet 1 by opening the cylindrical knitted fabric 1A. Namely, the tubular plain stitch fabric 1A is spirally cut along a locus 10 and is then opened to obtain a long reinforcement sheet 1.

Figure 4:
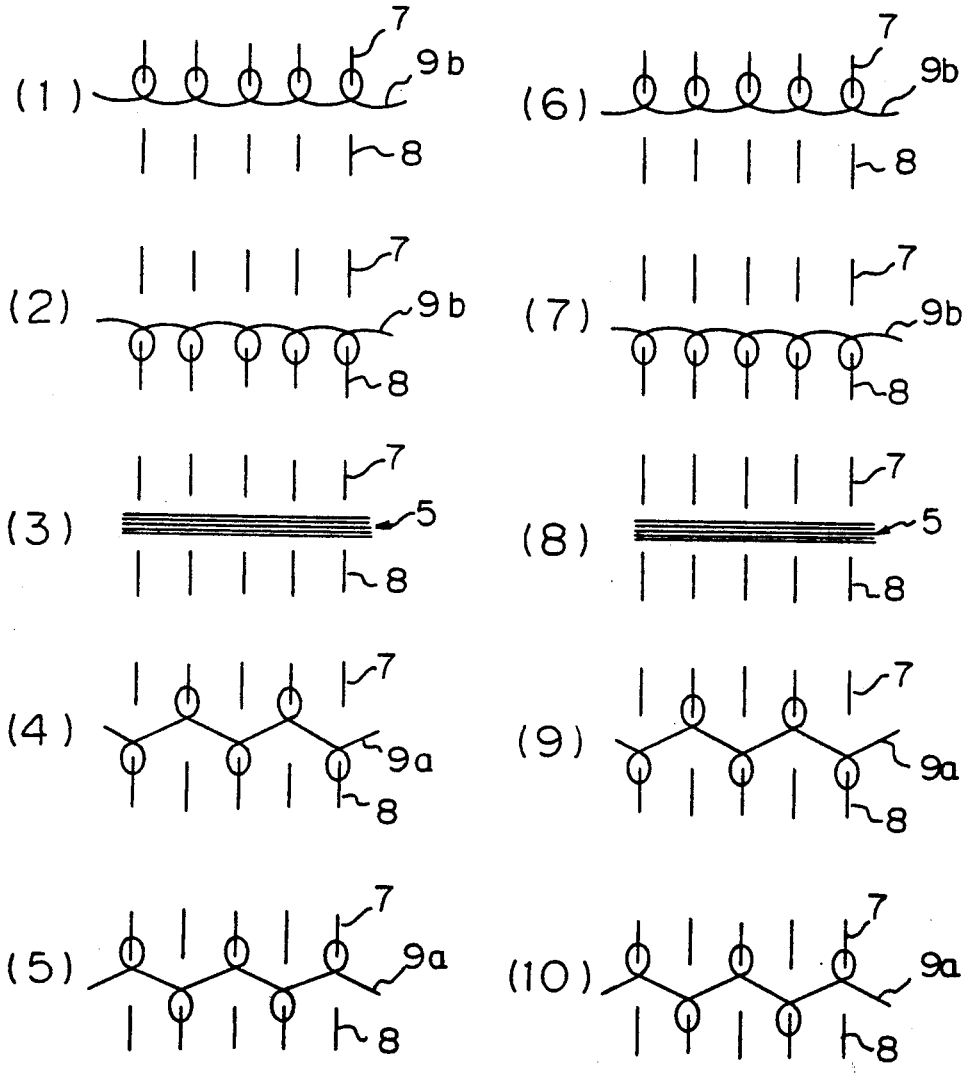
FIG. 4 is a knitting diagram (mock Milano rib stitch structure) for forming the reinforcement sheet of the present invention by using an interlock circular knitting machine.
Figure 5:
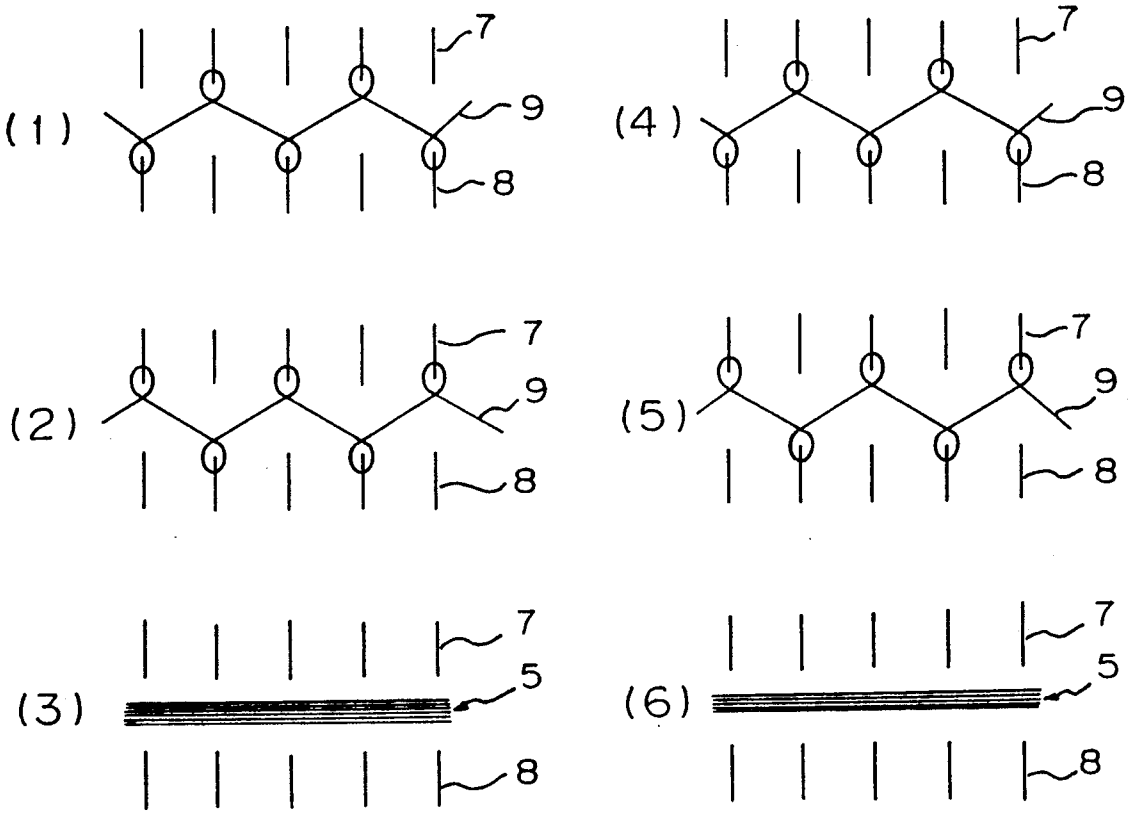
FIG. 5 is a knitting diagram (interlock stitch structure) for forming the reinforcement sheet of the present invention by using an interlock circular knitting machine.
Figure 6:
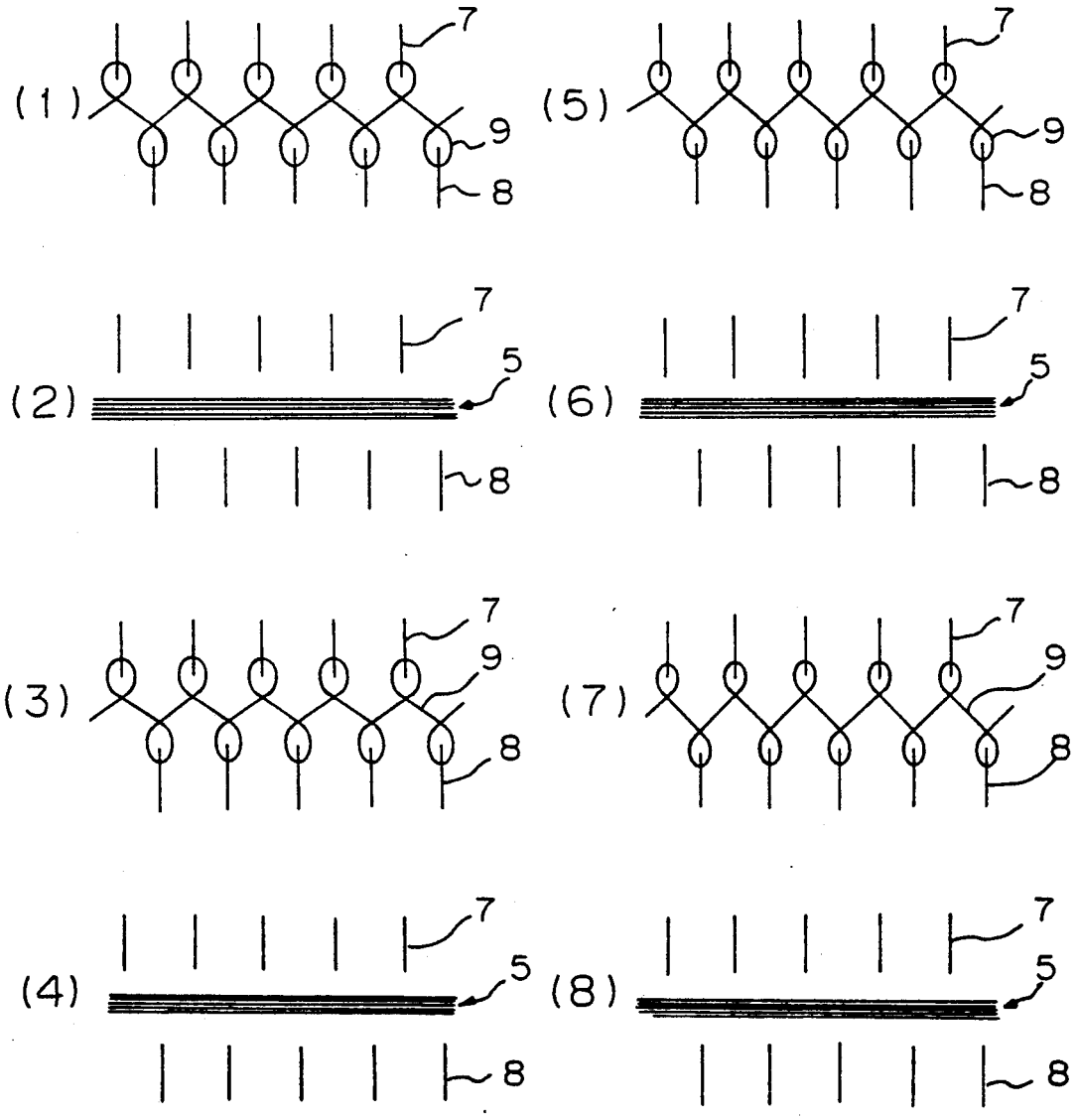
FIG. 6 is a 1×1 rib knitting structure diagram for forming the reinforcement sheet of the present invention according to the circular rib structure.

Such a long reinforcement sheet 1 can be prepared according to the knitting structure shown in FIGS. 4 to 6, in the same manner as described above.

In the knitting structure shown in FIG. 4, two types of yarns *9a* and *9b* are used as the matrix yarns 9.

Where the matrix yarns 9 have an especially small denier, and thus the knitting operation is difficult, a plating knitting can be carried out by using the matrix yarns 9 with soluble yarns.

The reinforcing yarn usable for the present invention preferably comprises at least one type of fibers selected from reinforcing fibers such as carbon fibers, silicon nitride fibers, glass fibers, aramid fibers, boron fibers, silicon carbide fibers, ceramic fibers, metal fibers, and alumina fibers. The type of the reinforcing yarn 5 is not particularly critical, and any of an untwisted yarn, a twisted yarn, a plied twisted yarn, an interlaced yarn, a spun yarn, and a doubled yarn can be used.

The number of filaments constituting the reinforcing yarn 5 is preferably from 1 to 100,000, and the thickness of the individual fibers in, for example, monofilaments or multifilaments, is preferably in the range of 0.3 to 5,000 denier, and the total fineness of the yarn is preferably 100 to 100,000 denier.

Preferably, a yarn comprising at least one type of heat-fusion-bondable fibers selected from nylon 6 fibers, nylon 66 fibers, polycarbonate fibers, polyacrylate fibers, polyether sulfone fibers, polyether imide fibers, polyphenylene sulfide fibers, polyaryl sulfone fibers, polyamide-imide fibers, polyether ether ketone fibers, polyether ketone fibers, polyimide fibers, and polyethylene terephthalate fibers is used as the matrix yarn 9 in the present invention. The matrix yarn can be a non-bulky monofilament or multifilament yarn, or a stretchable bulky yarn such as a false-twisted yarn can be used as the matrix yarn. Any of an untwisted yarn, a twisted yarn, and an interlaced yarn can be used as the matrix yarn.

The number of filaments constituting the matrix yarn 9 is preferably in the range of from 1 to 10,000, the thickness of the individual fibers in the monofilament or multifilament yarn is preferably 0.3 to 300 denier, and the total thickness of the matrix yarn is preferably 5 to 10,000 denier.

In the reinforcement sheet of the present invention, the volume ratio of the matrix yarns 9 to the entire sheet is preferably 30 to 60%, and therefore, preferably the volume ratio of the reinforcing yarns 5 to the entire sheet is 40 to 70%. Namely, in a fiber-reinforced plastic (FRP) material, the volume fraction of reinforcing fibers having high strength and high modulus of elasticity, such as carbon fibers, ceramic fibers or glass fibers, in FRP is a very important factor.

In general, the strength of FRP increases with an increase in the volume fraction of the reinforcing fibers, and the strength of the FRP is at the maximum when the volume fraction of the reinforcing fibers is about 70% and is gradually reduced as the volume fraction of the reinforcing fibers is increased. If the volume fraction of the reinforcing fibers is lower than 40%, the reinforcing effect is unsatisfactory, and accordingly, to obtain a superior reinforcing effect, preferably the volume fraction of the reinforcing yarn is in the range of from 40 to 70%.

Another embodiment of the present invention, especially another embodiment of the reinforcing yarn 5 to be inserted and knitted into the knitting structure of the matrix, will now be described.

In the sheet 1 shown in FIG. 1, the reinforcing yarns 5 are composed solely of reinforcing fibers, but the present invention is not limited to this embodiment, and in the present invention, preferably composite yarns composed of such reinforcing yarns and heat-fusion-bondable yarns are used. Preferably, the same type of yarns as the above-mentioned matrix yarns are used as the heat-fusion-bondable yarns.

Figure 7:
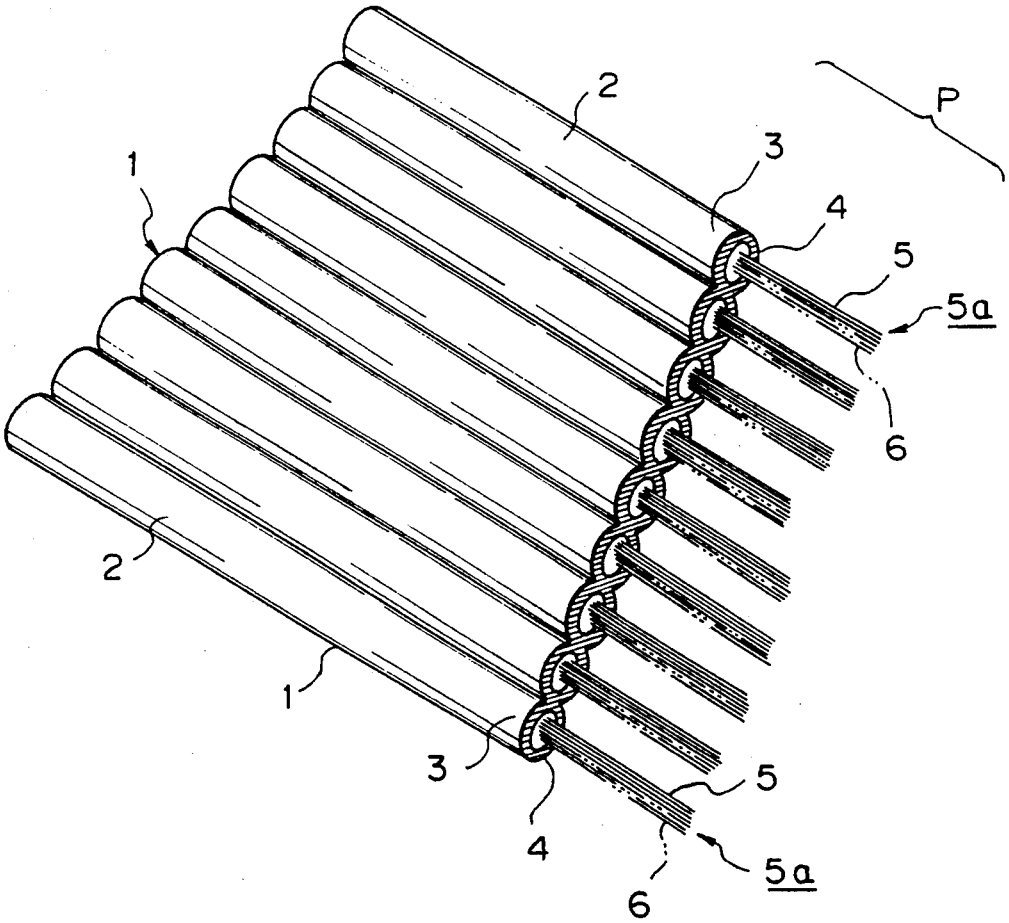
FIGS. 7, 8, 10, 15 and 16 are, respectively a partially cut-out perspective view of another embodiment of the reinforcement sheet of the present invention.

FIG. 7 shows an embodiment in which at least one reinforcing yarn 5 and at least one heat-fusion-bondable yarn 6 are doubled to form a composite yarn 5*a*, and this composite yarn 5*a* is inserted and knitted into the knitted fabric. In this embodiment, a composite yarn obtained by mix-spinning, interlacing or double-twisting these two types of yarns can be used instead of the doubled composite yarn. The knitting structure may be as shown in FIG. 2 or FIGS. 4 to 6. In this case, the reinforcing yarns 5 of FIG. 2 or FIGS. 4 to 6 are replaced by the composite yarns 5*a*.

Namely, in every step in which a predetermined number of courses are formed from the matrix yarn 9, a composite yarn 5*a* formed by doubling the reinforcing yarn 5 and heat-fusion-bondable yarn 6 is inserted and knitted into each course, to form a repeating knitting unit P, and this operation is repeated.

Figure 8:
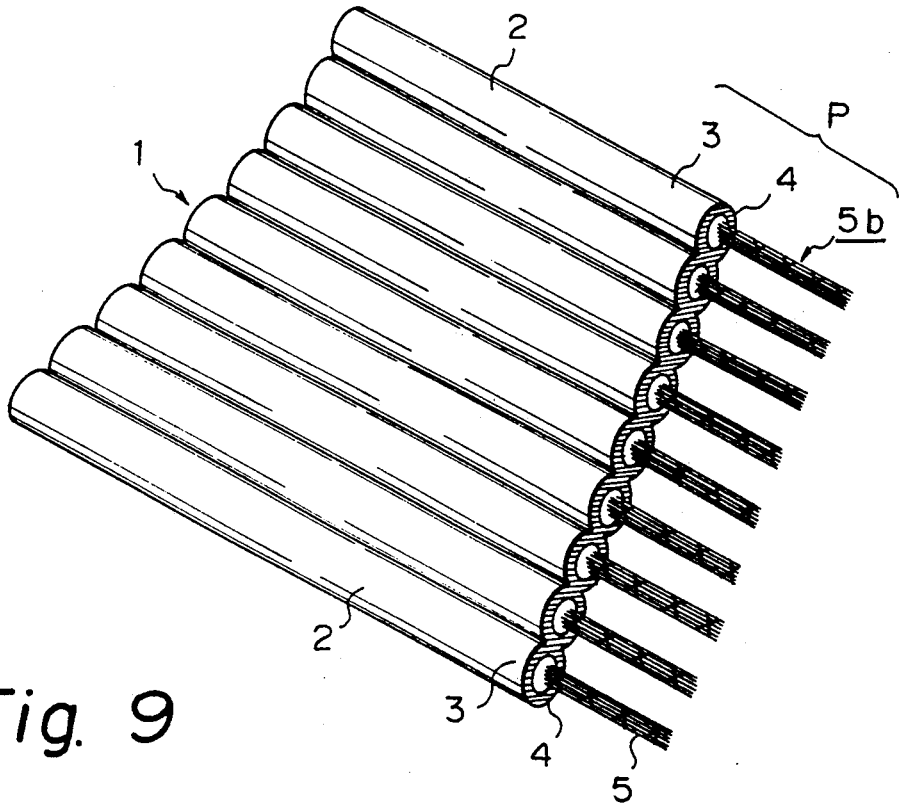
Figure 9:
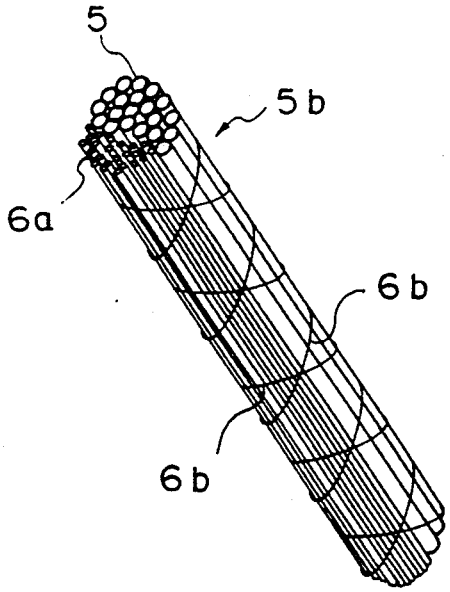
FIG. 9 is a perspective view of an embodiment of the reinforcing yarn to be used for the present invention.

FIG. 8 shows an embodiment in which a double-covered composite yarn 5*b* shown in FIG. 9 is inserted and knitted. The composite yarn 5*b* used in this embodiment is formed by doubling at least one reinforcing yarn 5 and at least one heat-fusion-bondable yarn 6*a*, to obtain a core yarn and winding (covering) with at least one heat-fusion-bondable yarn 6*b* around the core yarn. Also in this embodiment, the knitting operation is carried out in accordance with the knitting structure as shown in FIG. 2 or FIGS. 4 to 6. In this case, the reinforcing yarns 5 in FIG. 2 or FIGS. 4 to 6 are replaced by the composite yarns 5*b*.

Also in this embodiment, in every step in which a predetermined number of courses (several courses) knitting structures are formed from the matrix yarns 9, a composite yarn 5*b* is inserted into one course and covered with the matrix yarn 9 in the form of a tubular plain stitch-like knitting structure, to form a repeating knitting unit P, and this operation is repeated.

Figure 10:
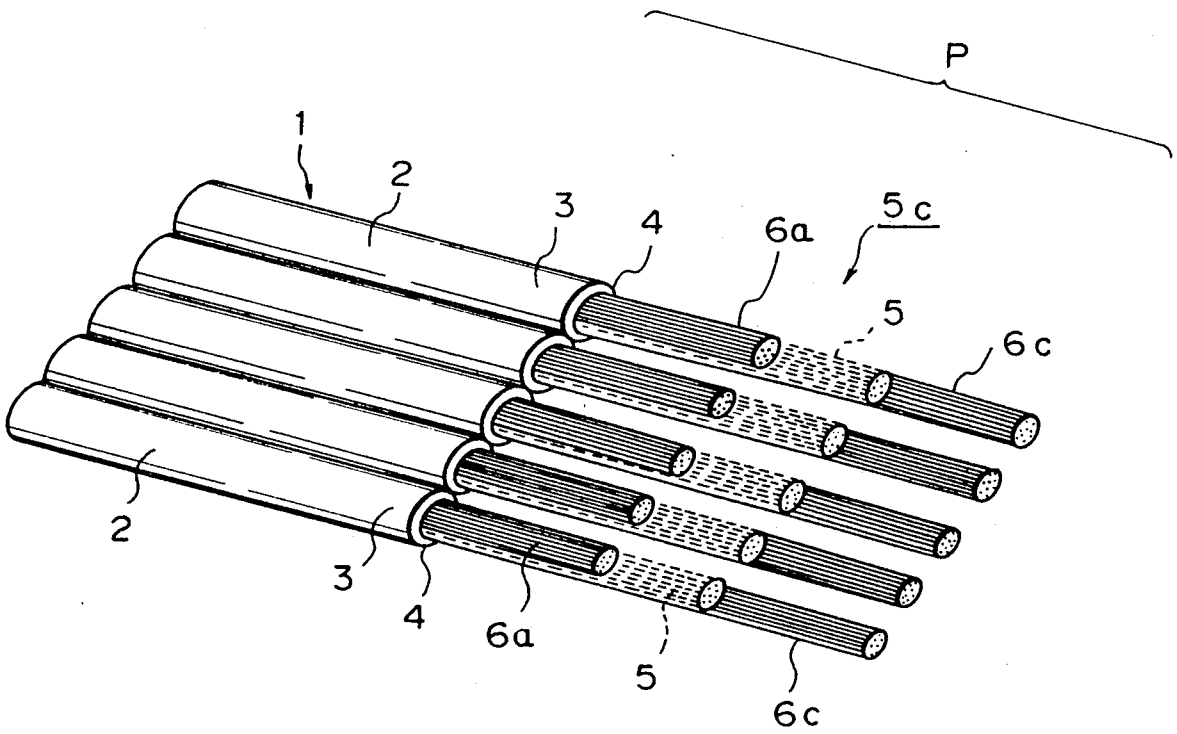

FIG. 10 shows a composite yarn 5*c* formed by sandwiching the reinforcing yarn 5 between heat-fusion-bondable yarns 6*a* and 6*c*, i.e., laminating these yarns in the order 6*a*, 5, and 6*c*.

In this embodiment, in every step in which a knitted structure having a predetermined number of courses (several courses) is formed from the matrix yarn 9, the composite yarn 5*c* is inserted in one course and the composite yarn 5*c* is covered with the matrix yarn 9, to form a tubular plain stitch-like knitting structure and a repeating knitting unit P, and this operation is repeated.

In the embodiment shown in FIG. 10, even when the yarn 6*c* is omitted and a composite yarn having a laminate structure of the yarns 6*a* and 5 is used, the intended effect is attained.

A knitting operation for forming a knitting structure from the composite yarn 5*c* can be performed according to the knitting structure diagrams of FIGS. 11 to 14. For example, at the first and second feeders shown in FIGS. 11-(1) and 11-(2), matrix yarns 9, 9 are respectively fed to an upper needle 7 and a lower needle 8 and are knitted to form a front fabric 3 and a back fabric 4 in a matrix knitted fabric 2. At the third, fourth and fifth feeders shown in FIGS. 11-(3), 11-(4) and 11-(5), the heat-fusion-bondable yarn 6*a*, reinforcing yarn 5 and heat-fusion-bondable yarn 6*c* are respectively inserted in succession between the front fabric 3 and the back fabric 4 and knitted. Further, at the sixth feeder shown in FIG. 11-(6), the matrix yarns 9 are fed to the upper needle 7 and lower needle 8 and knitted to form a tubular plain stitch-like knitted fabric 2.

Figure 11:
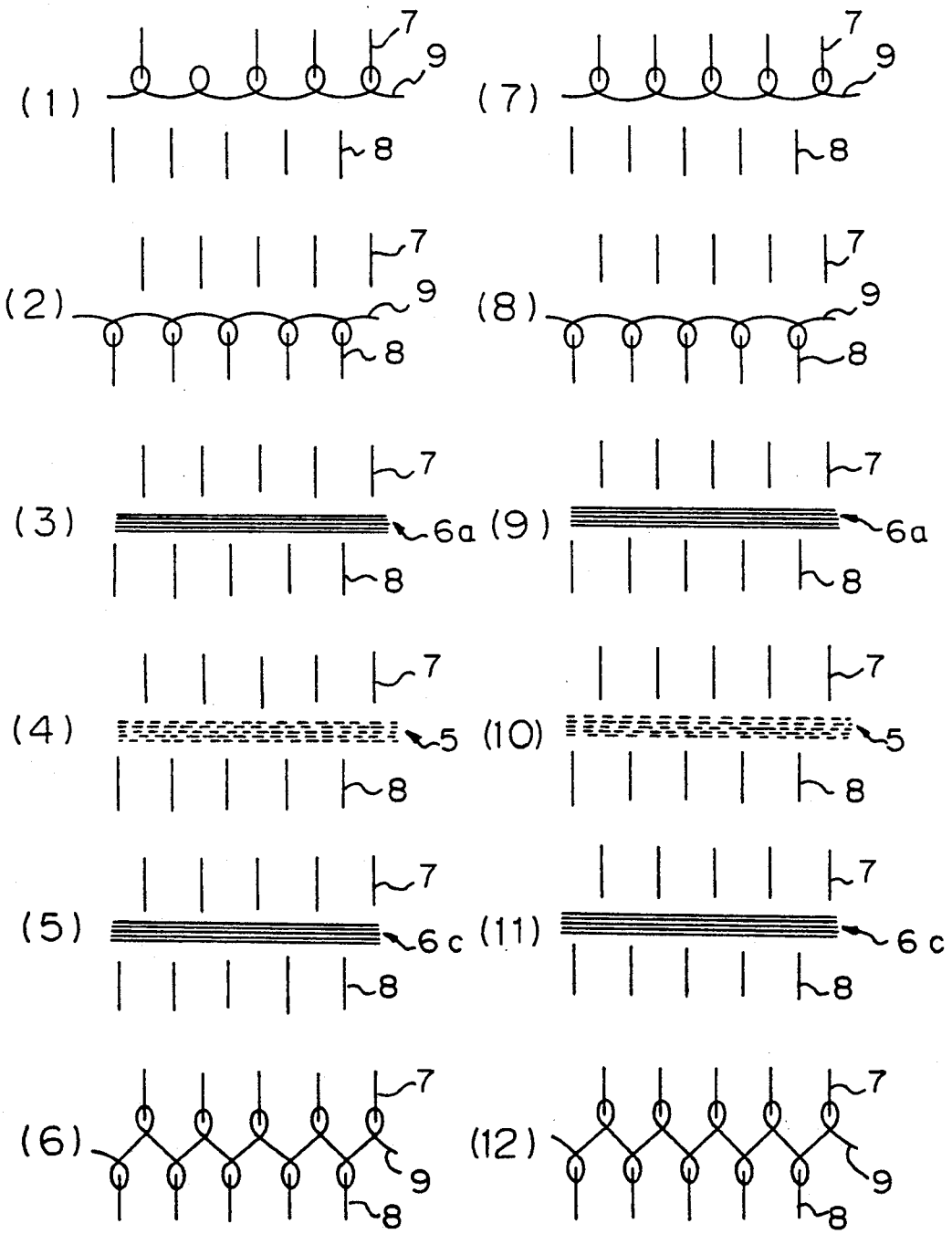
FIGS. 11 to 14 are respectively a knitting diagram for the production of the reinforcement sheet of the present invention shown in FIG. 10.

Furthermore, at the seventh to twelfth feeders shown in FIGS. 11-(7) through 11-(12), the same knitting operations as at the first to sixth feeders are repeated, and a cylindrical knitted fabric is continuously formed. This fabric is cut in the wale direction to a predetermined length, and is opened to form a flat reinforcement sheet 1 as shown in FIG. 10.

In this embodiment, when a bulky textured yarn, for example, a false-twisted yarn, is used as the heat-fusion-bondable yarns 6*a* and 6*c*, an enhanced covering effect on the reinforcing yarn 5 is attained, and the reinforcing yarn is not damaged while the resultant reinforcement sheet is handled. Moreover, since the heat-fusion-bondable yarn having a high bulkiness and stretchability has a greater elongation in form than that of the reinforcing yarn, and stretching or slackening does not occur in the reinforcing yarn. Accordingly, the characteristics of the molded article obtained by using this sheet are improved. Moreover, at the heating compression molding, a compressive force on the reinforcing fiber 5 such as the carbon fiber, due to a thermal shrinkage of the heat-fusion-bondable yarns 6*a* and 6*c*, is not generated, and therefore, the problem of a lowering of the doubling property by a slackening and bending of the reinforcing yarn is solved. Still further, since the heat-fusion-bondable yarns 6*a* and 6*c* are bulky textured yarns and have fine crimps, these fine crimps prevent an entanglement of the heat-fusion-bondable yarns 6*a* and 6*c* with the reinforcing yarn 5, and thus, an uneven distribution of the reinforcing yarn 5 during the handling of the reinforcement sheet can be prevented. Therefore, in the present invention, most preferably all of the heat-fusion-bondable yarns 6*a* and 6*c* and the matrix yarn 9 are bulky textured yarns. Moreover, it is allowable to use bulky textured yarns as the heat-fusion-bondable yarns 6*a* and 6*c* and a flat yarn as the matrix yarn 9, or flat yarns as the heat-fusion-bondable yarns 6*a* and 6*c*, and a bulky yarn as the matrix yarn 9. In each case, better results can be obtained than the results obtained by using the flat yarns as all of the matrix yarn 9 and the heat-fusion-bondable yarns 6*a* and 6*c*.

Preferably, yarns to which a sizing agent or an oiling agent is not applied are used as the matrix yarn, heat-fusion-bondable yarns 6*a* and 6*c*, and reinforcing yarn 5, and also preferably, these yarns are knitted without applying an oiling agent to the yarns. In this case, a step of washing the reinforcement sheet before the heating compression molding step can be omitted, and the lowering of the doubling property of the reinforcing yarn 5 due to the bending thereof or damage to the reinforcing yarn 5 can be prevented.

Figure 12:
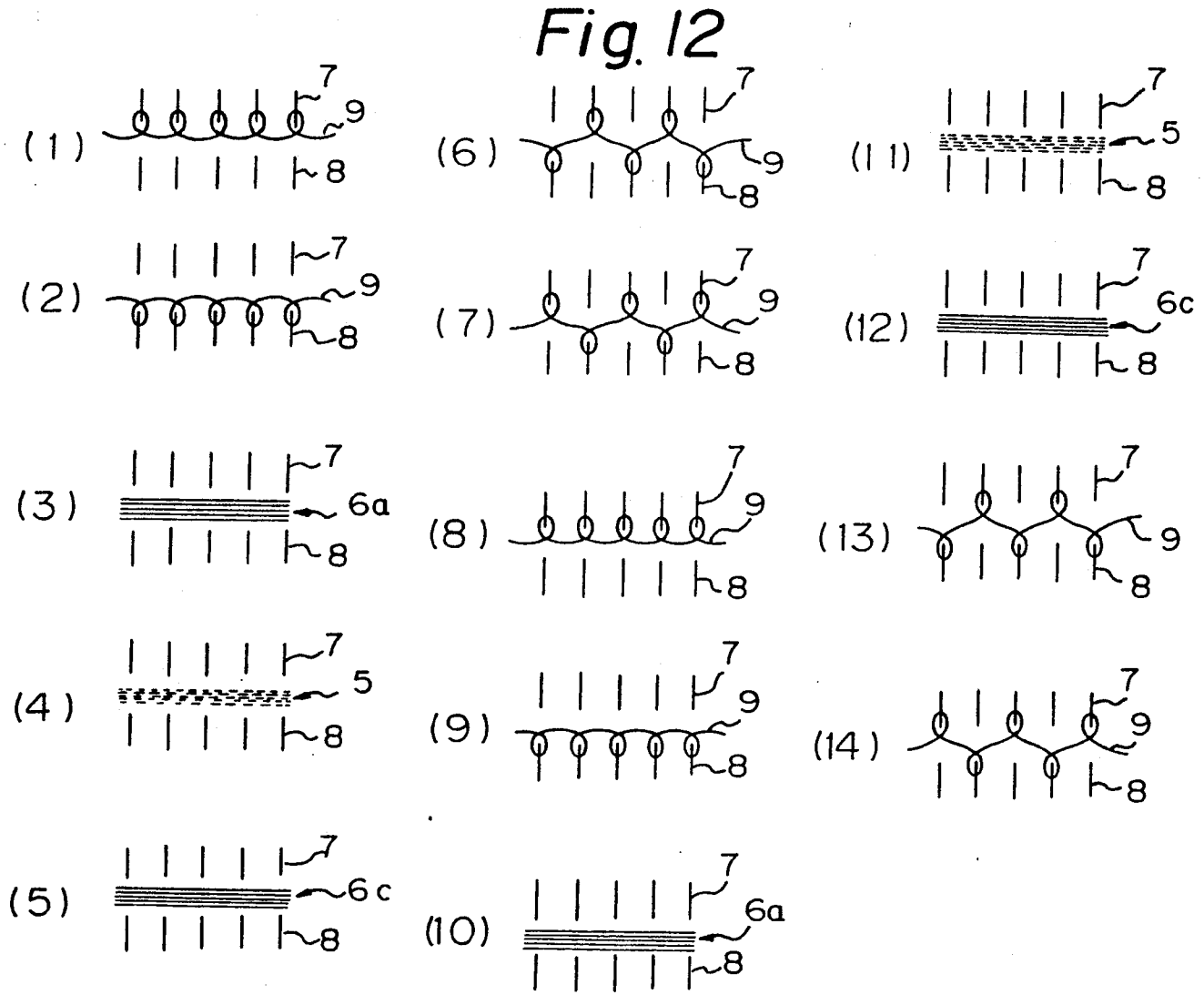
Figure 13:
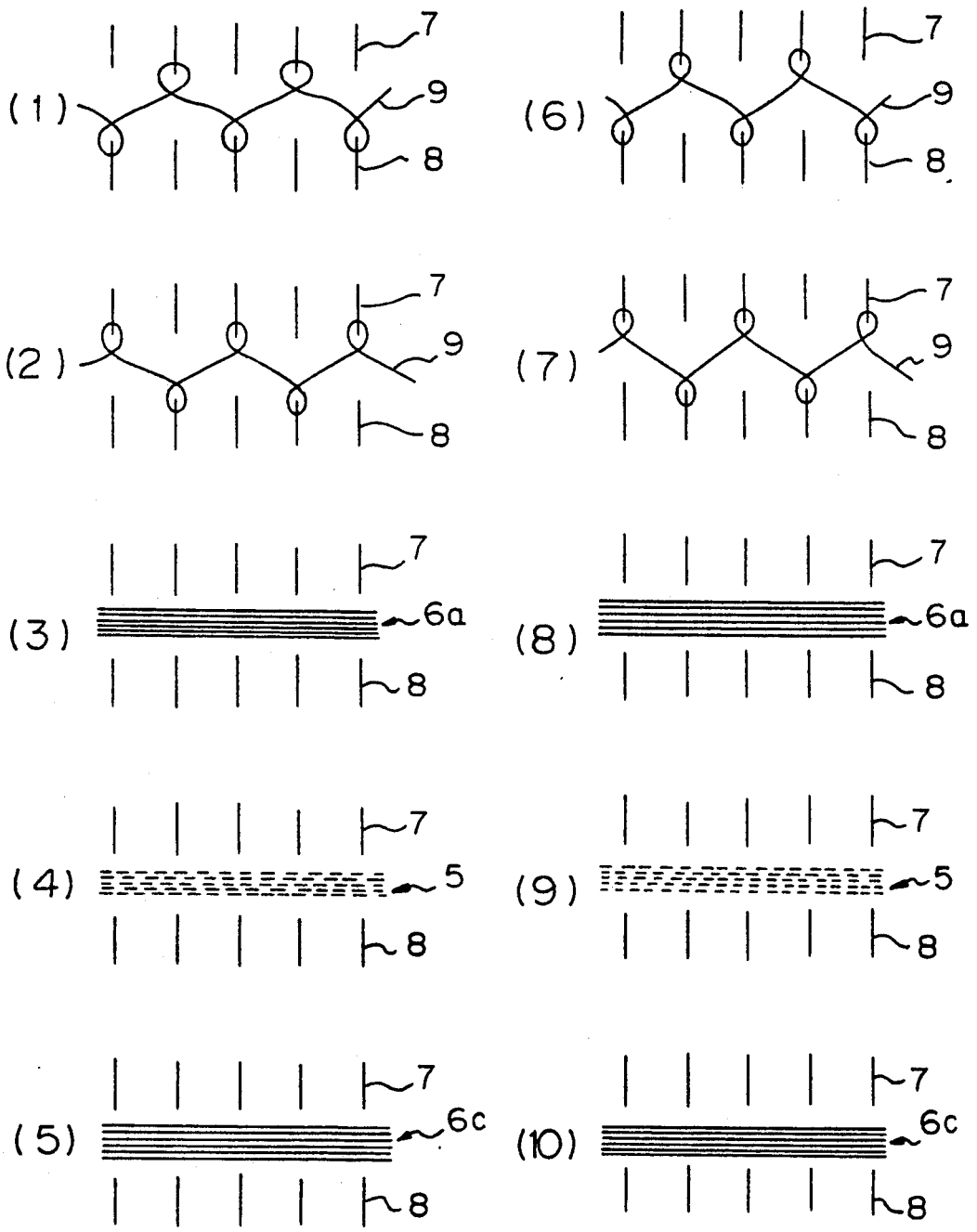
Figure 14:
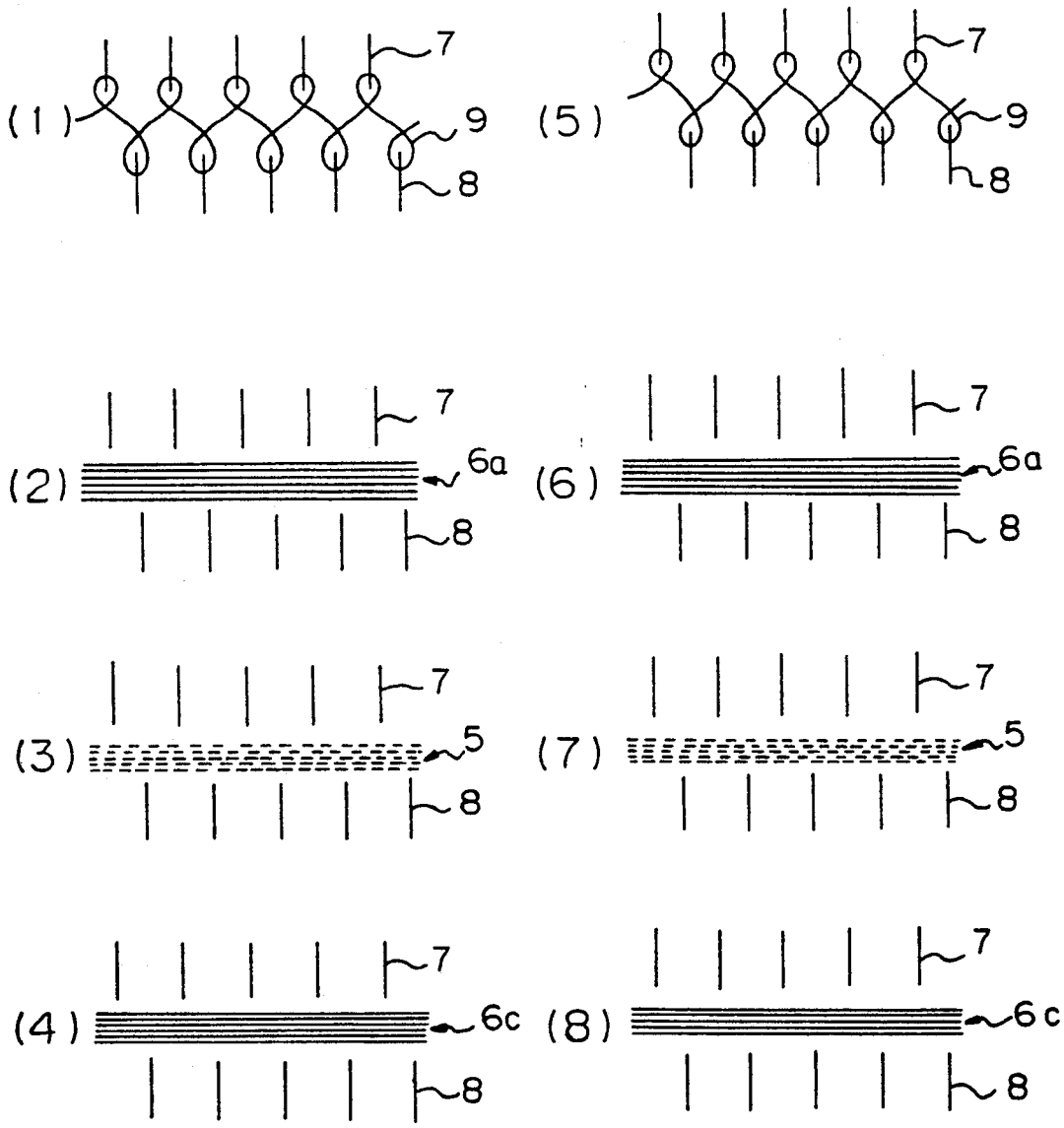

The reinforcement sheet of the present invention can be prepared by knitting composite yarns 5*c* composed of the heat-fusion-bondable 6*a* and 6*c* and reinforcing yarn 5 in accordance with the knitting structure as shown in FIGS. 12 to 14.

Figure 15:
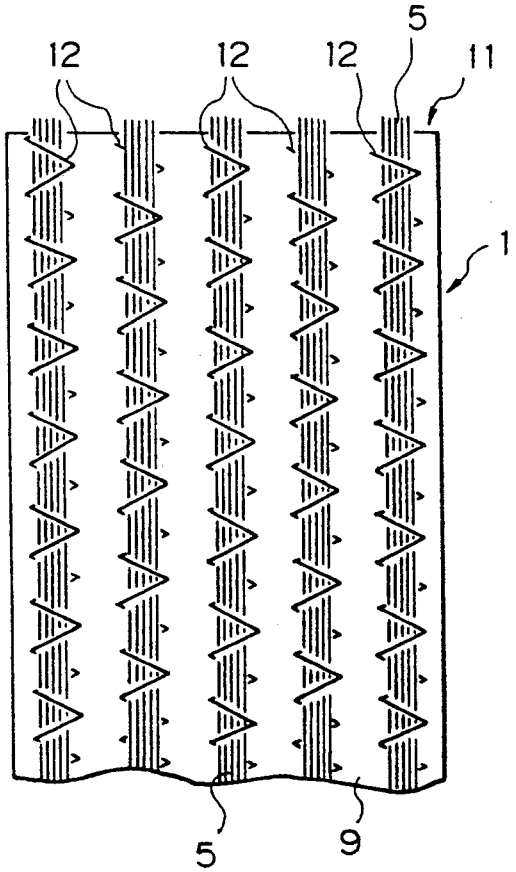
Figure 16:
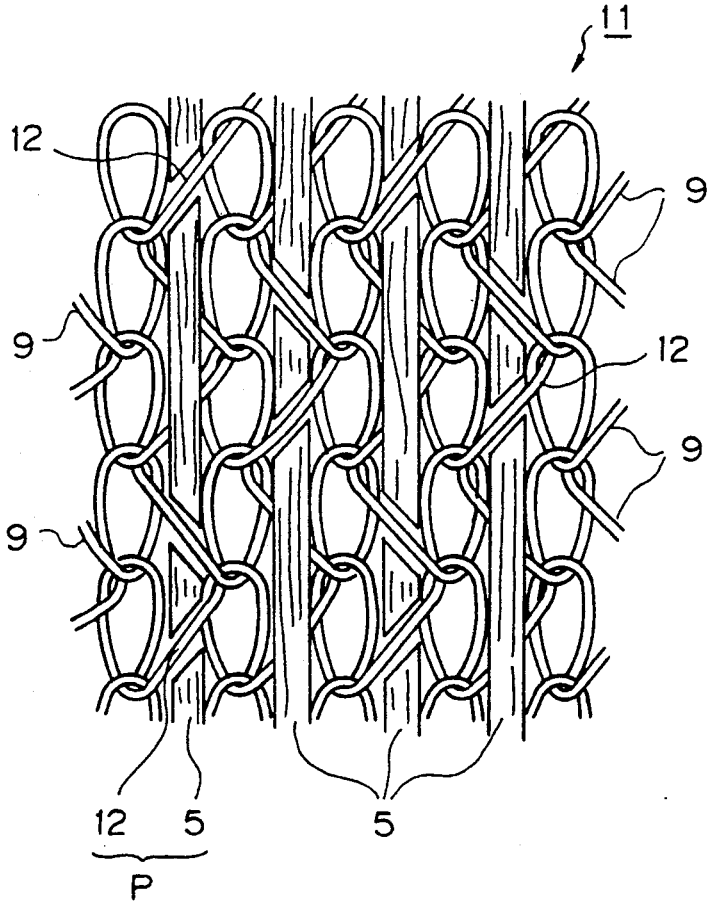

FIG. 15 shows an embodiment of the reinforcement sheet of the present invention comprising reinforcing yarns 5 covered with rocking yarns 12, and FIG. 16 is an enlarged view of the knitting structure of the sheet shown in FIG. 15.

Referring to FIGS. 15 and 16, in knitting structure having a predetermined number of courses (several courses) formed from the matrix yarn 9, the reinforcing yarn 5 is inserted into each course and the rocking yarn 12 composed of the matrix yarn 9 crosses the reinforcing yarn 5 to cover the reinforcing yarn 5 and form a repeating knitting unit, and when this operation of forming the knitting unit is repeated, the reinforcement sheet of the present invention is obtained.

More specifically, in the reinforcement sheet 1 shown in FIG. 15, a matrix knitted fabric 11 having a warp knitting hosiery structure is formed by entangling and covering reinforcing yarns 5 arranged flat and in parallel to and spaced from one another with rocking yarns 12.

FIG. 16 shows a knitting structure of a single warp knitted fabric. In every step in which a knitting structure having a predetermined number of courses is formed from the matrix yarns 9, the reinforcing yarn 5 is knitted in the knitting structure, and this reinforcing yarn 5 is supported by the rocking yarn 12 of the same type as that of the matrix yarn.

Preferably, a warp knitting hosiery structure or Russel knitting hosiery structure is used as the matrix knitting structure 11.

A composite yarn as described hereinbefore can be used as the reinforcing yarn 5, but a composite yarn having the sandwich structure as shown in FIG. 10 is most preferably used.

As apparent from the foregoing description, in the reinforcement sheet of the present invention formed by inserting and knitting the reinforcing yarns 5 in combination with the heat-fusion-bondable yarns 6 into the matrix knitted fabric, at the thermal forming step, the heat-fusion-bondable yarns 6 in the melted state easily permeate into spaces among the constituent individual filaments in the reinforcing yarns 5, and therefore, a stable and homogeneous molded article can be obtained.

As apparent from the foregoing description, it is easily understood that the volume fraction of the matrix yarns 9 includes the volume fraction of the heat-fusion-bondable yarns combined with the reinforcing yarns 5.

The reinforcement sheet of the present invention is not limited to a broad sheet, and a ribbon-shaped or tape-shaped sheet having a width of several millimeters to scores of millimeters is included. This embodiment will now be described.

Figure 17:
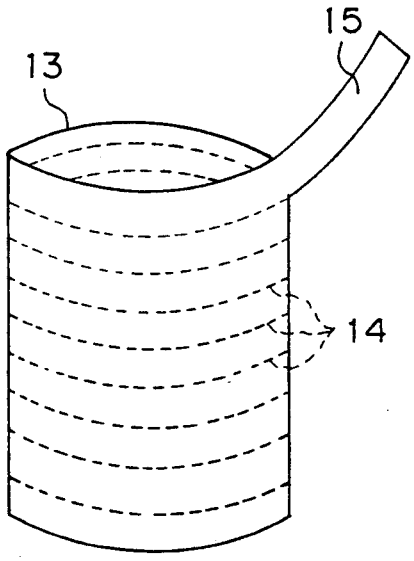
FIG. 17 is a perspective explanatory drawing illustrating the step of continuously preparing a long tape-shaped reinforcement material from a circular knitted fabric.

FIG. 17 shows a cylindrical knitted fabric 13 for a tape-shaped reinforcement. At every predetermined number of courses, a soluble yarn 14 is knitted and the cylindrical knitted fabric 13 is cut, and a long tape-shaped reinforcement 15 is continuously and successively obtained.

Figure 18:
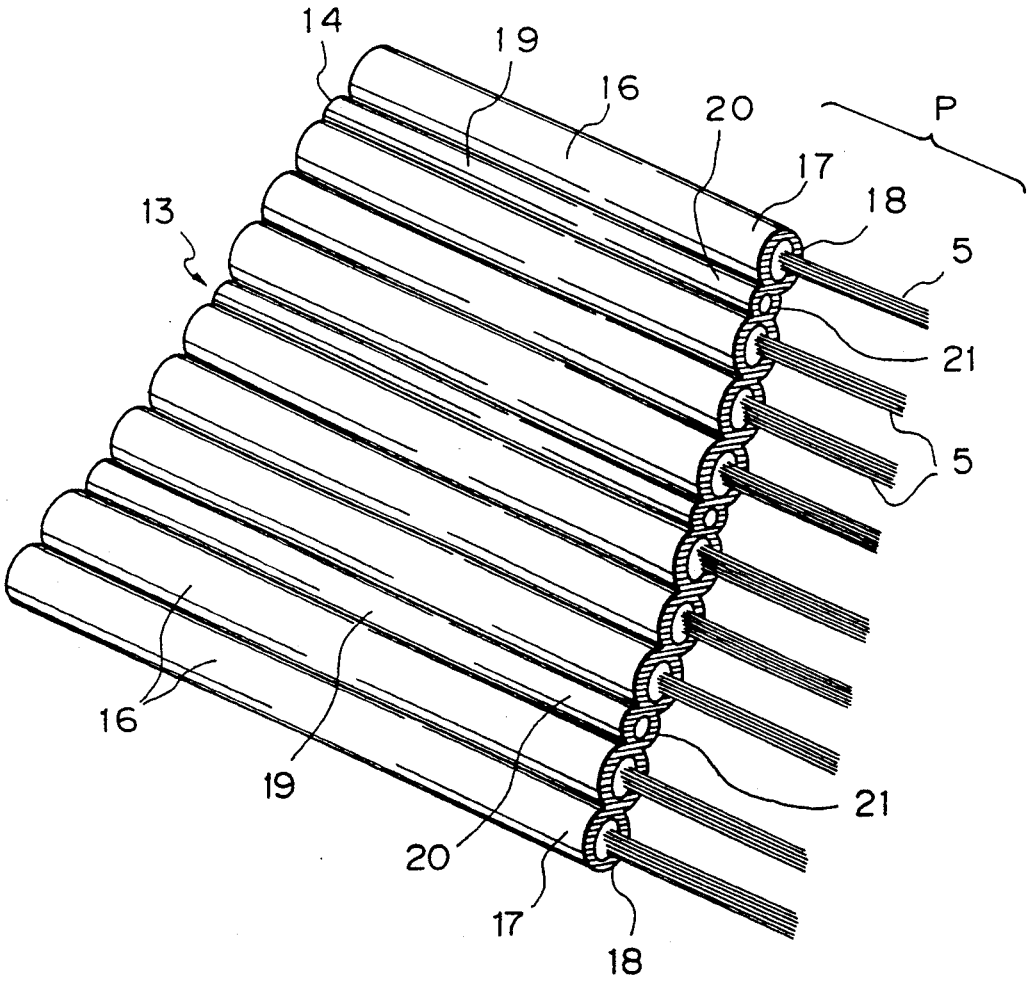
FIG. 18 is a partially cut-out perspective explanatory drawing showing a cylindrical knitted fabric for forming the tape-shaped reinforcement sheet of the present invention.

FIG. 18 is a partially cut-out diagram showing the cylindrical knitted fabric 13 for the tape-shaped reinforcement. A tubular plain stitch hosiery matrix 16 has a front fabric 17 and a back fabric 18 and the reinforcing yarns 5 are inserted between the front fabric 17 and back fabric 18. Soluble parts 19 formed by knitting the soluble yarn 14 are formed at predetermined intervals in the matrix 16, and the soluble parts have a front fabric 20 and a back fabric 21.

Figure 19:
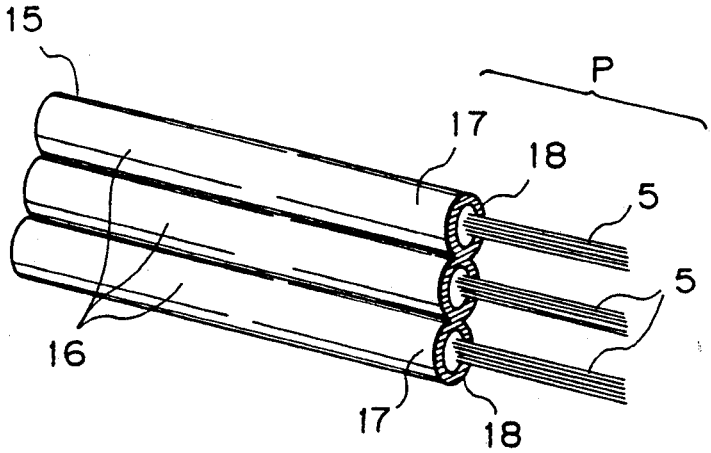
FIG. 19 is a partially cut-out perspective explanatory drawing illustrating the tape-shaped reinforcement sheet of the present invention; and, FIG. 20 is a knitting diagram for forming a cylindrical knitted fabric for producing the tape-shaped reinforcement sheet shown in FIG. 17.

If this cylindrical knitted fabric 13 is subjected to a dissolving treatment or melting treatment, the soluble parts 19 are dissolved or melted and the fabric 13 is cut to form a tape-shaped sheet 15 shown in FIG. 19.

Figure 20:
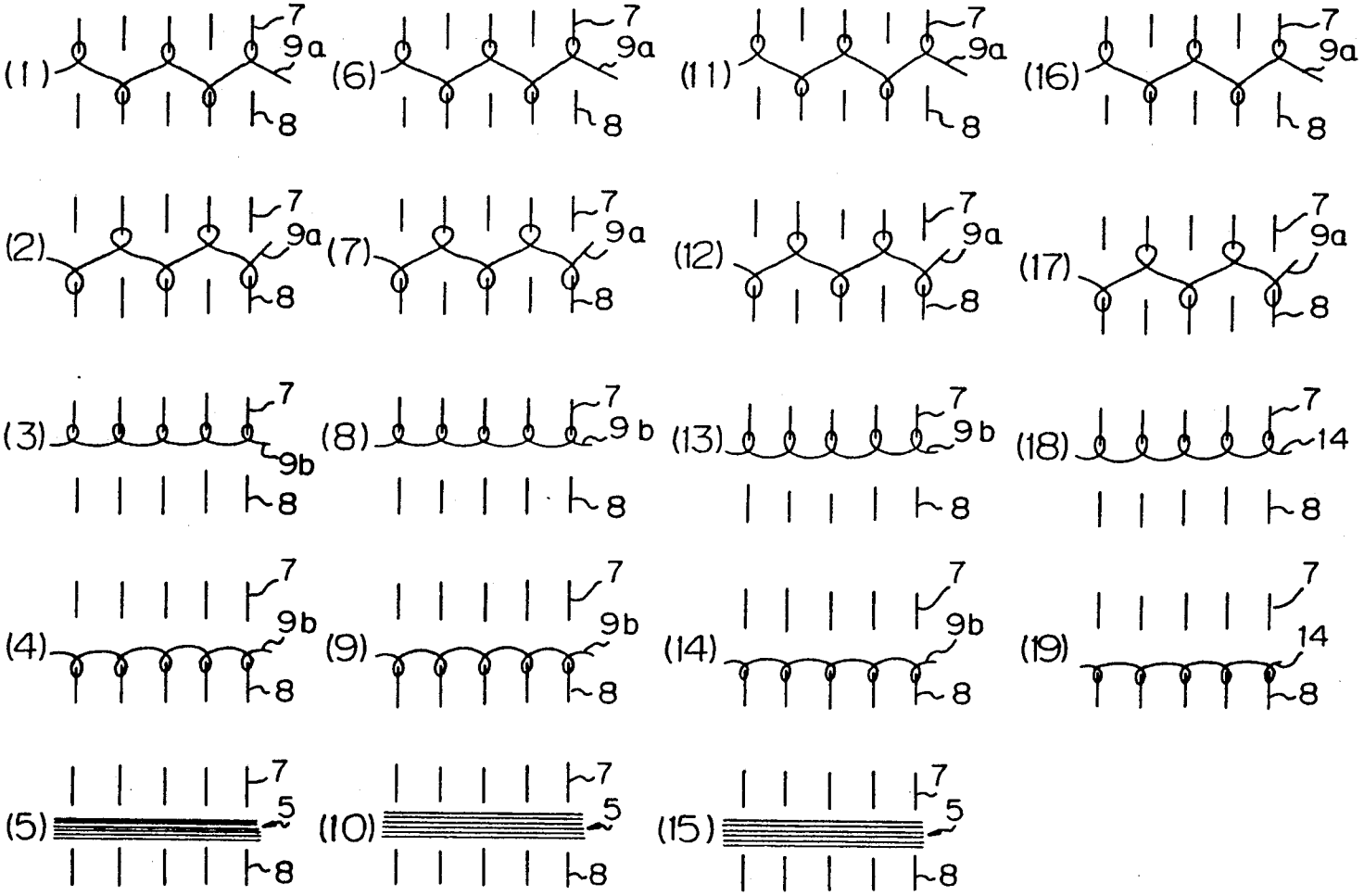

FIG. 20 shows a mock Milano modified knitting structure of the reinforcement sheet of the present invention prepared by using an interlock tubular knitting machine. First, at first and second feeders shown in FIGS. 20-(1) and 20-(2), matrix yarns **9*a* having a small thickness are fed to an upper needle 7 and a lower needle 8 and are connected and knitted, and then at third and fourth feeders shown in FIGS. 20-(3) and 20-(4), matrix yarns 9*b* having a large thickness are fed to the upper needle 7 and lower needle 8 and are knitted, whereby a front fabric 17 and a back fabric 18 of the tubular plain stitch fabric 16 are formed at the first to fourth feeders. Then, at the fifth feeder shown in FIG. 20-(5), the reinforcing yarns 5 are inserted, between the front fabric 17 and back fabric 18 of the tubular plain stitch fabric 16 to be knitted to and cover same. At sixth to tenth feeders shown in FIGS. 20-(6) through 20-(10) and eleventh to fifteenth feeders shown in FIGS. 20-(11) and 20-(15), the same knitting operations as at the first to fifth feeders are carried out and at sixteenth and seventeenth feeders shown in FIGS. 20-(16) and 20-(17), the same connecting knitting operations as at the first and second feeders are carried out. At eighteenth and nineteenth feeders shown in FIGS. 20-(18) and 20-(19), soluble yarns 14 are fed to the upper needle 7 and lower needle 8, and knitted to separately form a back fabric 21 and a front fabric 20 of a soluble knitted portion 19, then the knitting operations, at the first to nineteenth feeders in FIGS. 20-(1) to (19) are repeated, and thus a cylindrical knitted fabric shown in FIG. 17** is successively formed.

Note, in the knitting structure shown in FIG. 20, preferably the number of repetitions of the unit operations in the formation of the tubular plain stitch fabric 16 and the insertion and knitting of the reinforcing yarns 5 is in the range of from 2 to 30.

The matrix yarns **9*a* and 9*b* may have the same thickness, and pointed out hereinbefore, the reinforcing yarns 5 may be double-covered or single-covered composite yarns. Furthermore, the composite yarns formed by doubling or double-twisting the reinforcing yarns 5 and heat-fusion-bondable yarns or sandwich type composite yarns shown in FIG. 10** can be used.

As the knitting structure of the cylindrical knitted fabric 13 for the tape-shaped reinforcement, a knitting structure shown in FIG. 20. a circular rib knitted texture, and a Milano rib knitted texture can be adopted.

For the soluble yarn 14, preferably various fibers capable of being easily melted or dissolved by hot air or the like, such as a low-melting-point nylons, polyethylenes, polypropylenes, nylon 6, nylon 66 or a polycarbonates are used. Preferably, the melting point of the soluble yarn 14 is 110° to 220° C. and lower than the melting point of the matrix yarn 9 or heat-fusion-bondable yarn 6.

For the soluble yarn 14, preferably water-soluble fibers or fiber soluble in an appropriate solvent are used, for example, a low-melting-point nylons (solvent: calcium chloride-methanol mixed solution) and a polycarbonates (solvent: methylene chloride) are used.

EXAMPLES

The present invention will now be described in detail with reference to the following examples.

EXAMPLE 1

To prepare a sheet shown in FIG. 7, a circular rib knitter having a needle cylinder diameter of 412 mm (and supplied by Gunze Limited) was used as a knitting machine, and the Milano rib modified stitch knitting structure shown FIG. 2 was used as the knitting structure. Also, 50-denier (filament number: 6) polyether ether ketone (PEEK) fiber yarns (and supplied by Teijin Limited; the specific gravity was 1.3) were used for the matrix yarns 9 for forming the matrix structure, 720-denier (filament number: 80) polyether ether ketone fiber yarns (supplied by Teijin Limited; the specific gravity was 1.3) were used for the heat-bondable yarns 6, and 1850-denier (filament number: 3,000) carbon fiber yarns (trademark: Magnamite AS4, supplied by Sumitomo-Hercules; the specific gravity was 1.8) were used for the reinforcing yarns 5.

The number of reinforcing yarns 5 and heat-fusion-bondable yarns 6 to be inserted in the course direction was about 13 per cm, and when the reinforcing yarns 5 and heat-fusion-bondable yarns 6 were inserted and knitted, the yarns 5 and 6 were doubled and knitted to form a cylindrical fabric.

The cylindrical fabric was cut to a length of about 1 m in the knitting direction, and simultaneously, was cut in the wale direction, the longitudinal direction to open the fabric. As a result, a reinforcement sheet having a base weight of 350 g/m$^2$, a volume fraction ratio of the reinforcing yarns of about 52%, a volume ratio of the matrix yarns of about 14.4% and a volume ratio of the heat-fusion bondable yarns of 33.6% was obtained.

EXAMPLE 2

To prepare a sheet shown in FIG. 8 by using covered composite yarns shown in FIG. 9, a circular rib knitter having a needle cylinder diameter of 412 mm (supplied by Gunze Limited) was used as the knitting machine, and the Milano rib modified stitch knitting structure shown in FIG. 2 was used as the knitting structure. 50-denier (filament number: 6) polyether ether ketone fiber yarns (supplied by Teijin Limited) were used for the matrix yarns 9, 720-denier (filament number: 80) polyether ether ketone fiber yarns (supplied by Teijin Limited) and 50-denier (filament number: 6) polyether ether ketone fiber yarns (supplied by Teijin Limited) were used for the heat-fusion-bondable yarns 6*a* and 6*b*, and carbon fiber yarns (trademark: Magnamite AS4, supplied by Sumitomo-Hercules) were used for the reinforcing yarns 5. The reinforcing yarns 5 and heat-fusion-bondable yarns 6*a* were doubled and the resultant doubled core composite yarns were double-covered with the heat-fusion-bondable yarns 6*b* (the primary twist number was 1,000 per meter in Z direction and the final twist number was 700 per meter in S direction) to prepare composite yarns 5*b*.

When the composite yarns 5*b* were knitted, the number of the yarns 5*b* to be inserted in the course direction was about 9 yarns per centimeter.

The cylindrical fabric was cut to a length of about 1 m in the course direction and in the wale direction, to open the fabric, and thus a reinforcement sheet having a base weight of 300 g/m$^2$, in which the volume ratio of the matrix yarns 9 including the heat-fusion-bondable yarns 6*a* and 6*b* was about 40% based on the entire sheet and the volume ratio of the reinforcing yarns 5 was 60% based on the entire sheet, was obtained.

Then one of the reinforcement sheets obtained above was washed in a hot aqueous solution containing 4% of NaOH and maintained at 60° C., and the sheet was then washed three times with hot water maintained at 60° C. The sheet was then naturally dried, doubled in one direction, laminated, and placed in a heating compression molding machine, maintained at a temperature of 370° C. under a pressure of 30 kg/cm$^2$ for 20 minutes, and then cooled to 120° C. at a cooling rate of 15° C./min to obtain a unidirectional (UD) plate. The mechanical characteristics of the molded plate were such that the tensile strength was 183 kg/mm$^2$ and the flexural strength was 225 kg/mm$^2$. The molded plate performed well as a composite material.

EXAMPLE 3

To prepare a sheet shown in FIG. 1, an interlock circular rib knitter (made by Gunze Limited) having a needle cylinder diameter of 500 mm was used as the knitting machine and a Mock Milano rib modified stitch knitting structure shown in FIG. 4 was adopted as the knitting structure.

Also, 50-denier (filament number: 24) polyether ether ketone fiber false-twisted yarns (supplied by Teijin Limited) were used as the matrix yarns 9*a*, 125-denier (filament number: 50) polyether ether ketone fiber false-twisted yarns (supplied by Teijin Limited) were used as the other matrix yarns 9*b*, and 1850-denier (filament fiber: 3,000) carbon fiber yarns (Magnamite AS4 supplied by Sumitomo-Hercules) were used for the reinforcing yarn.

When the reinforcing yarns 5 were knitted, the number of the yarns 5 inserted in the course direction was about 9 yarns per centimeter.

The resultant cylindrical fabric was cut to a length of about 1 m in the course direction, and then cut in the wale direction to open the fabric. The resultant reinforcement sheet had a base weight of 300 g/m$^2$, in which sheet the volume ratio of the matrix yarns 9*a* and 9*b* was about 40% based on the entire sheet and the volume ratio of the reinforcing yarns 5 was 60% based on the entire sheet.

Then one of the reinforcement sheets obtained above was washed in a hot aqueous solution containing 4% of NaOH and maintained at 60° C., and the sheet was washed three times with hot water maintained at 60° C. The sheet was then naturally dried, doubled in one direction, laminated, and placed in a heating compression molding machine, maintained at a temperature of 370° C. under a pressure of 30 kg/cm$^2$ for 20 minutes, and then cooled to 120° C. at a cooling rate of 15° C./min to obtain a unidirectional (UD) plate. The mechanical characteristics of the molded plate were such that the tensile strength was 183 kg/mm$^2$ and the flexural strength was 255 kg/mm$^2$. The molded plate performed well as a composite material.

EXAMPLE 4

To prepare a sheet shown in FIG. 10, a circular rib knitter having a needle cylinder diameter of 412 mm (supplied by Gunze Limited) was used as the knitting machine, and a circular rib modified stitch knitting structure shown in FIG. 14 was adopted as the knitting texture.

Also, 50-denier (filament number: 24) polyether ether ketone fiber-false-twisted yarns (supplied by Teijin Limited) were used as the matrix yarns 9, 360-denier (filament number: 48) polyether ether ketone fiber-false-twisted yarns (supplied by Teijin Limited) were used as the heat-fusion-bondable yarns 6*a* and 6*c*, and 1850-denier (filament number: 3000) carbon fiber yarns (trademark: Magnamite AS4, supplied by Sumitomo-Hercules) were used for the reinforcing yarns 5.

When the reinforcing yarns 5 were knitted, the number of the yarns 5 inserted in the course direction was about nine yarns per centimeter.

The obtained cylindrical fabric was cut to a length of about 1 m in the course direction and then in the wale direction to open the fabric. The resultant reinforcement sheet had a base weight of 300 g/m$^2$, in which the volume ratio of the matrix yarns 9 and heat-fusion-bondable yarns 6*a* and 6*c* was about 40% based on the entire sheet and the volume ratio of the reinforcing yarns 5 was 60% based on the entire sheet. The surface of the sheet was substantially completely covered with the false-twisted PEEK yarns and the little or no carbon fibers appeared.

The resultant reinforcement sheet was washed with a hot aqueous solution containing 4% of NaOH and maintained at 60° C., washed three times with hot water at 60° C., naturally dried, doubled in one direction and laminated. Slippage of the layers did not occur at the lamination and a slackening or stretching of the carbon fiber yarns did not occur when handling, and thus the lamination could be properly performed. Then, 16 -laminated sheets thus prepared were piled, placed in a heat compression molding machine, maintained at a temperature of 370° C. under a pressure of 30 kg/cm$^2$ for 20 minutes, and cooled to 120° C. at a cooling rate of 15° C./min to obtain a unidirectional (UD) plate having a thickness of about 3 mm. The resultant molded plate had a tensile strength of 185 kg/mm$^2$ and a flexural strength of 253 kg/mm$^2$ and exhibited a good appearance as a composite plate.

EXAMPLE 5

To prepare a sheet shown in FIG. 10, the same knitting machine and knitting texture as described in Example 4 were used.

Also, 110-denier (filament number: 9) polyetherimide fiber false-twisted yarns (supplied by Teijin Limited) were used as the matrix yarns 9, 360-denier (filament number: 30) polyether-imide (PEI) fiber false-twisted yarns (supplied by Teijin Limited) were used as the heat-fusion-bondable yarns 6*a* and 6*c*, and 1850-denier (filament number: 3000) carbon fiber yarn (trademark: Magnamite SA4, supplied by Sumitomo-Hercules) were used for the reinforcing yarn 5.

When the reinforcing yarns 5 were knitted, the number of the yarns 5 inserted in the course direction was about 9 yarns per centimeter.

The resultant cylindrical fabric was cut to a length of about 1 m in the course direction and then in the wale direction to open the fabric. The resultant reinforcement sheet had a base weight of 300 g/m$^2$, in which sheet the volume ratio of the matrix yarns 9 and heat-fusion-bondable yarns 6*a* and 6*c* was about 40% based on the entire sheet and the volume ratio of the reinforcing yarns 5 was 60% based on the entire sheet. The surface of the sheet was substantially completely covered with the false-twisted PEI yarns and the few or no carbon fibers appeared.

Then, 12 reinforcement sheets thus produced were arranged in one direction and laminated. Slippage of the layers did not occur at the lamination, a slackening or stretching of the carbon fiber yarns did not occur when handling, and the lamination could be properly performed. Then the laminated sheet was placed in a heat compression molding machine, maintained at a temperature of 345° C. under a pressure of 30 kg/cm$^2$ for 20 minutes, and cooled to 120° C. at a cooling rate of 15° C./min to obtain a unidirectional (UD) plate having a thickness of about 2.3 mm. The resultant molded plate had a tensile strength of 182 kg/mm$^2$ and a flexural strength of 244 kg/mm$^2$ and exhibited a good form as a composite plate.

EXAMPLE 6

To prepare a sheet shown in FIGS. 15 and 16, 50-denier (filament number: 24) polyether ether ketone fiber false-twisted yarns (supplied by Teijin Limited) were used as the matrix yarns 9 of the matrix fabric 11, and 1850-denier (filament number: 3000) carbon fiber yarns (trademark: Magnamite SA4, supplied by Sumitomo-Hercules) were used for the reinforcing yarns 5.

The resultant warp-knitted fabric was cut to a length of about 1 m in the course direction and then in the wale direction to obtain a reinforcement sheet having a base weight of 300 g/m$^2$, in which the volume ratio of the matrix yarn 9 was about 40% based on the entire sheet and the volume ratio of the reinforcing yarn 5 was 60% based on the entire sheet.

The surface of the sheet was substantially completely covered with the false-twisted PEEK yarns and the few or no carbon fibers appeared.

Then twelve reinforcement sheets thus produced were arranged in one direction and laminated. Slippage of the layers did not occur at the lamination, a slackening or stretching of the carbon fiber yarns did not occur when handling, and the lamination could be properly performed. Then the laminated sheet was placed in a heat compression molding machine, maintained at a temperature of 370° C. under a pressure of 30 kg/cm$^2$ for 20 minutes, and cooled to 120° C. at a cooling rate of 15° C./min to obtain a unidirectional (UD) plate having a thickness of about 2.3 mm. The resultant molded plate had a tensile strength of 184 kg/mm$^2$ and a flexural strength of 221 kg/mm$^2$ and exhibited a good form as a composite plate.

EXAMPLE 7

To prepare a sheet shown in FIGS. 15 and 16, 50-denier (filament number: 24) polyether ether ketone fiber false-twisted yarns (supplied by Teijin Limited) were used as the matrix yarns 9 of the matrix fabric 11. A composite yarn formed by sandwich-laminating the composite yarns 5*c*, heat-fusion-bondable yarns 6*a*, reinforcing yarns 5 and heat-fusion-bondable yarns 6*c*, as shown in FIG. 10, was used. 240-denier (filament number: 30) polyether ether ketone false-twisted yarns (supplied by Teijin Limited) were used as the heat-fusion-bondable yarns 6*a* and 6*c*, and 1850-denier (filament number: 3,000) carbon fiber yarns (trademark: Magnamite SA4, supplied by Sumitomo-Hercules) were used for the reinforcing yarns 5.

The resultant warp-knitted fabric was cut to a length of about 1 m in the course direction and then in the wale direction to obtain a reinforcement sheet having a base weight of 290 g/m$^2$, in which the volume ratio of the matrix yarn 9 was 30% based on the entire sheet, the volume ratio of the heat-fusion-bondable yarns 6*a* and 6*c* was 25% based on the entire sheet, and the volume ratio of the reinforcing yarn 5 was 45% based on the entire sheet.

The surface of the sheet was substantially completely covered with the reinforcing PEEK yarns 9 and heat-fusion-bondable yarns 6*a* and 6*c*, and few if any carbon fibers appeared.

Then 11 reinforcement sheets thus produced were arranged in one direction and laminated. Slippage of the layers did not occur at the lamination, and slackening or stretching of the carbon fiber yarns did not occur when handling, as in Example 4 and the lamination could be properly performed. Then the laminated sheet was placed in a heat compression molding machine, maintained at a temperature of 370° C. under a pressure of 30 kg/cm$^2$ for 20 minutes and cooled to 120° C. at a cooling rate of 15° C./min to obtain a unidirectional (UD) plate having a thickness of about 2.1 mm. The obtained molded plate had a tensile strength of 141 kg/mm$^2$ and a flexural strength of 185 kg/mm$^2$ and exhibited a good form as a composite plate.

EXAMPLE 8

To obtain a sheet shown in FIG. 18, an interlock circular rib knitter having a needle cylinder diameter of 500 mm (supplied by Gunze Limited) was used as the knitting machine, and a Mock Milano rib modified stitch knitting structure as shown in FIG. 20 was used as the knitting structure.

Also 50-denier (filament number: 6) polyether ether ketone fiber false-twisted yarns (supplied by Teijin Limited) were used as the matrix yarns 9*a* having a small thickness, 125-denier (filament number: 50) polyether ether ketone fiber false-twisted yarns (supplied by Teijin Limited) was used as the reinforcing yarns 9*b* having a large thickness, 1850-denier (filament number: 3000) carbon fiber yarns (trademark: Manamite SA4, supplied by Sumitomo-Hercules) were used for the reinforcing yarns 5, and 30-denier (filament number: 12) polycarbonate fiber yarns (supplied by Teijin Limited) were used for the soluble yarn 14.

The resultant cylindrical fabric was cut to a length of about 1 m in the course direction, the fabric was immersed in a solution of methylene chloride for about 5 minutes, and then naturally dried to provide a tape reinforcement having a tape width of about 3 mm and a tape base weight of 1 g/m, in which the volume ratio of the reinforcing yarns 5 was about 57% based on the entire fabric.

Since the surface of the resultant tape reinforcement was substantially completely covered with the PEEK false-twisted yarns, the filaments in the reinforcing yarn did not extend to the surface.

While the tape reinforcement was handled, the matrix yarns were not disentangled nor were the reinforcing yarns separated.

INDUSTRIAL APPLICABILITY

The reinforcement sheet of the present invention has the following advantages.

(1) The reinforcing yarns 5 need not be bonded to one another through a resin, although this bonding is indispensable according to the conventional technique. Namely, by heat compression at the molding step, the heat-fusion-bondable yarns 6 (6*a*, 6*b*, and 6*c*) and matrix yarns 9 are melted to bond the reinforcing yarns 5 to one another. Accordingly, the sheet of the present invention has a superior abrasion resistance and strength and can be suitably used as a reinforcement material for a shell of a ship or a part of an airplane.

(2) The reinforcing yarns 5 are inserted and knitted in the linear state without being bent, and are completely covered with the matrix fabric. Accordingly, while the reinforcement sheet of the present invention is being handled, the reinforcing yarns 5 are not separated and the performances of the reinforcing yarns are satisfactory.

(3) The reinforcement sheet of the present invention has a superior flexibility and pliability, and therefore, the reinforcement sheet can be satisfactorily shaped even into a part having a complicated curved surface.

(4) When the reinforcement sheets of the present invention are piled, since the slip friction between the sheets is large, slippage of the sheets does not occur even if many sheets are piled. Furthermore, the reproducibility of the position or angle of the sheets is good and a reinforcing material can be easily prepared precisely as designed.

(5) Accordingly, the reinforcement sheet of the present invention can be very valuably used for the production of various reinforcing materials.

We claim:

1. A reinforcement sheet having a knitting structure comprising a plurality of reinforcing yarns 5, a plurality of matrix yarns 9 and a plurality of heat-fusion-bondable yarns 6 (6*a*, 6*b*, 6*c*), wherein (1) the reinforcing yarns are held in the linear state without being bent, and at least one reinforcing yarn is doubled, mixed, entangled, or double-twisted with at least one heat-fusion-bondable yarn or arranged between at least two heat-fusion-bondable yarns 6 to form composite yarns, (2) the composite yarns are arranged in parallel to and spaced from one another, (3) the matrix yarns are knitted around the composite yarns to cover the composite yarns whereby a plurality of repeating knitting units P, which are in parallel to one another, are formed and said knitting units are connected to one another to form a continuous matrix knitting structure, (4) the total volume fraction of the composite yarns is 30 to 60%, and (5) the volume ratio of the reinforcing yarns to the entire sheet is 40 to 70%.

2. A reinforcement sheet as set forth in claim 1, wherein a plurality of the repeating knitting units P in parallel to one another have a tubular knitting structure in which the composite yarns are covered with the matrix yarns, and said tubular knitting units P are connected through course knitted structures each composed of the matrix yarns, whereby a hosiery knitting structure is provided.

3. A reinforcement sheet as set forth in claim 1, wherein a plurality of the repeating knitting units P in parallel to each other have a racked knitting structure in which the composite yarns 5 are covered with racking yarns consisting of the matrix yarns 9, and the racked knitting units P are connected through course knitting structures each composed of the matrix yarns, whereby a knitting structure is provided.

4. A reinforcement sheet as set forth in claim 1, wherein at lest one reinforcing yarn 5 is doubled with at least one heat-fusion-bondable yarn 6*a*, to form a composite core yarn, and at least one heat-fusion-bondable entangling yarn 6*b* is wound around said core yarn to form a composite yarn.

5. A reinforcement sheet as set forth in claim 1, wherein each reinforcing yarn 5 is arranged between at least two heat-fusion-bondable yarns 6*a* and 6*c* to form a sandwich-type composite yarn.

6. A reinforcement sheet as set forth in claim 1, wherein the reinforcing yarn 5 comprises at least one member selected from the group consisting of carbon fibers, silicon nitride fibers, glass fibers, aramid fibers, boron fibers, silicon carbide fibers, metal fibers and alumina fibers.

7. A reinforcement sheet as set forth in claim 1 wherein the reinforcing yarn 5 consists of ceramic fibers.

8. A reinforcement sheet as set forth in claim 1, wherein the matrix yarn 9 comprises at least one member selected from the group consisting of nylon 6 fibers, nylon 66 fibers, polycarbonate fibers, polyacrylate fibers, polyether sulfone fibers, polyether-imide fibers, polyphenylene sulfide fibers, polyamide-imide fibers, polyaryl sulfone fibers, polyether ether ketone fibers, polyether ketone fibers, polyimide fibers and polyethylene terephthalate fibers.

9. A reinforcement sheet as set forth in claim 1, wherein the heat-fusion-bondable yarn 6 (*6a*, *6b*, *6c*) is of the same type as that of the matrix yarn 9.

* * * * *